US009354563B2

(12) United States Patent
Kirikubo et al.

(10) Patent No.: US 9,354,563 B2
(45) Date of Patent: May 31, 2016

(54) POWER SUPPLY AND ITS CONTROL METHOD FOR AN ELECTROMAGNETIC INDUCTION HEATING APPARATUS, FIXING DEVICE AND IMAGE FORMATION APPARATUS

(71) Applicant: Konica Minolta, Inc., Chiyoda-ku (JP)

(72) Inventors: Seiichi Kirikubo, Toyohashi (JP); Masaaki Goto, Toyohashi (JP); Yutaka Yamamoto, Shinshiro (JP); Takahiro Tsujimoto, Toyokawa (JP); Hiroyuki Watanabe, Hachioji (JP); Hidenori Mine, Toyohashi (JP); Masato Ishii, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/014,967

(22) Filed: Aug. 30, 2013

(65) Prior Publication Data

US 2014/0064768 A1 Mar. 6, 2014

(30) Foreign Application Priority Data

Sep. 3, 2012 (JP) ..... 2012-193352

(51) Int. Cl.

*G03G 15/20* (2006.01)
*H05B 6/06* (2006.01)
*G03G 15/00* (2006.01)

(52) U.S. Cl.

CPC ..... *G03G 15/2039* (2013.01); *G03G 15/205* (2013.01); *H05B 6/06* (2013.01); *G03G 15/80* (2013.01)

(58) Field of Classification Search

CPC . G03G 15/2039; G03G 15/205; G03G 15/80; H05B 6/06

USPC ..... 399/69, 70, 88

See application file for complete search history.

(56) References Cited

U.S. PATENT DOCUMENTS

2002/0108947 A1 8/2002 Tsuruya
2002/0149890 A1 * 10/2002 Kaneko et al. ..... 361/18

(Continued)

FOREIGN PATENT DOCUMENTS

JP 2000-223253 * 8/2000 ..... H05B 6/14
JP 2002-231427 A 8/2002

(Continued)

OTHER PUBLICATIONS

Decision to Grant a Patent issued on Oct. 28, 2014 in the corresponding Japanese Patent Application No. 2012-193352 and English language translation (3 pages).

*Primary Examiner* — Sophia S Chen
(74) *Attorney, Agent, or Firm* — Buchanan Ingersoll & Rooney PC

(57) ABSTRACT

An electromagnetic induction heating apparatus comprises: a resonance circuit that includes a inductor and a capacitor; a direct-current electric power supply; and a switching element performing ON and OFF switching of electric power supplied to the resonance circuit by the direct-current electric power supply; performs intermittent control of the electric power supply by controlling the ON and OFF switching at regular intervals, and by performing control to stop the electric power supply when not controlling the ON and OFF switching, wherein during the intermittent control, the switching control unit performs gradual control such that, upon beginning the control of the ON and OFF switching, the electric power supply gradually increases to reach a target value, and upon stopping the control of the ON and OFF switching, the electric power supply gradually decreases from the target value until stopping, such that the gradual decrease involves fewer steps than the gradual increase.

16 Claims, 11 Drawing Sheets

(56) References Cited

U.S. PATENT DOCUMENTS

| | | | | |
|---|---|---|---|---|
| 2008/0118265 | A1* | 5/2008 | Kinouchi et al. | 399/70 |
| 2009/0214243 | A1 | 8/2009 | Yoda et al. | |
| 2010/0014880 | A1* | 1/2010 | Kinouchi et al. | 399/67 |
| 2010/0028037 | A1* | 2/2010 | Song | 399/70 |
| 2012/0187107 | A1* | 7/2012 | Liu et al. | 219/492 |

FOREIGN PATENT DOCUMENTS

| | | | | |
|---|---|---|---|---|
| JP | 2004-191523 | A | 7/2004 | |
| JP | 2008-257971 | * | 10/2008 | H05B 6/12 |
| JP | 2009-204717 | A | 9/2009 | |
| JP | 2011-253682 | * | 12/2011 | H05B 6/12 |
| JP | 2011-253682 | A | 12/2011 | |

* cited by examiner

POWER SUPPLY AND ITS CONTROL METHOD FOR AN ELECTROMAGNETIC INDUCTION HEATING APPARATUS, FIXING DEVICE AND IMAGE FORMATION APPARATUS

This application is based on application No. 2012-193352 filed in Japan, the contents of which are hereby incorporated by reference.

BACKGROUND OF THE INVENTION (1) Field of the Invention

The present invention relates to an electromagnetic induction heating device that controls electric power supplied to a resonant circuit that is connected to a switching element by performing control of ON and OFF switching by a switching element, and has an inductor and a capacitor, and that performs electromagnetic induction of heating a component subject to heating through electromagnetic flux in the inductor. In particular, the present invention pertains to technology for preventing the occurrence of noise produced when the electromagnetic induction heating device performs intermittent control of switching the switching element ON and OFF when low electric power is supplied, which is likely to cause switching loss.

(2) Description of the Related Art

Electromagnetic induction heating has come to be used for a printer, copier, or other image formation apparatus, as a heating method that provides the image formation apparatus with a shorter warm-up period and energy savings.

FIG. 10 illustrates a specific example of an electromagnetic induction heating device for an image formation apparatus using a conventional electromagnetic induction heating method. As shown, an electromagnetic induction heating device 100 is connected to a commercial power source (e.g., AC 100V) 110 serving as a source of electric power, a rectifier circuit 120, an electric power detection circuit 130, an inverter circuit 140, and an electromagnetic induction heating control unit 150. The commercial power source 110 supplies alternating current that is converted into direct current by the rectifier circuit 120 and subsequently supplied to the inverter circuit 140.

The electric power detection circuit 130 detects electric power in the rectifier circuit 120 and outputs detection results to the electromagnetic induction heating control unit 150. The inverter circuit 140 includes a resonant circuit 141 having an inductor 1411 and a capacitor 1412 connected in parallel, and a switching element 142 connected in series to the resonant circuit 141. The inverter circuit 140 repeatedly operates the supply of direct current to the resonant circuit 141 to be ON and OFF as the switching element 142 is controlled to be ON and OFF, supplies high-frequency electric power to the inductor 1411, and causes electromagnetic induction heating in the non-diagrammed component subject to heating (e.g., a fixing roller) that is electromagnetically connected to the inductor 1411.

The electromagnetic induction heating control unit 150 performs pulse width modification (hereinafter, PWM) control of controlling the duty cycle of the switching element 142, thereby controlling the electric power supplied to the resonant circuit 141. The duty cycle is a proportion (percentage) of time during which the switching element is ON relative to the PWM signal cycle. A higher duty cycle produces control such that more electric power is supplied. Conversely, a lower duty cycle produces control such that less electric power is supplied.

FIG. 11 illustrates the relationships between voltage and current applied to the switching element when the switching element is switched ON and OFF during PWM control (see Japanese Patent Application Publication No. 2009-204717). Section (a) of FIG. 11 represents a switching signal indicating whether the switching element is ON or OFF. Sections (b) and (c) of FIG. 11 respectively indicate the changes in voltage and current applied to the switching element.

As shown in sections (a) through (c) of FIG. 11, the PWM control beneficially executes zero-crossing control of switching the switching element ON and OFF such that the applied voltage and current are approximately zero. This approach enables prevention of the loss of electric power occurring in the switching element (hereinafter termed switching loss) and of the overheating or breakage therein.

However, when low electric power is supplied to the resonant circuit (e.g., when the temperature of the fixing roller is sufficiently high such that there is no great difference from the target temperature), the switching element is ON for a shorter time during the PWM control. This causes less electric power to be accumulated in the inductor of the resonant circuit during the ON time. As a result, and as shown in sections (d), (e), and (f), the vibration amplitude of the voltage applied to the switching element is reduced and the timing becomes such that the switching element is switched ON before the voltage decreases all the way to zero, such that zero-crossing control cannot be performed.

Thus, when the switching element is switched ON and OFF with timing on the order of microseconds, switching loss occurs every time the switching element is switched ON, which produces increasing switching loss and is likely to cause breakage of the switching element through the production of heat that accompanies switching loss.

Accordingly, intermittent PWM control is executed so as to intermittently execute PWM control at regular time intervals. Thus, when the PWM control is being executed, the time during which the switching element is ON is made longer than is the case in the above-described continuous PWM control. This enables the prevention of switching loss by increasing the electric power supplied to the resonant circuit. Also, this approach provides a stop period during which the PWM control is stopped, and enables electric power supplied in excess to be cancelled out by lengthening the ON time.

However, when the above-described intermittent PWM control is performed, dramatic variations in electromagnetic flux are produced during the transition from a stop period during which the PWM control is stopped to an execution period during which the PWM control is executed, and the transition from the execution period to the stop period. Thus, the component subject to heating (i.e., the fixing roller) is repeatedly deformed, which results in a problem of noise production.

In order to prevent the problem of noise production, the supply of electric power to the resonant circuit may be modified to be gradual during the start and stop of the execution period for the PWM control, thus preventing the dramatic change in electromagnetic flux (see also Japanese Patent Application Publication No. 2011-253682). However, although this approach does prevent the occurrence of noise, a further problem occurs in that the switching loss is increased.

SUMMARY OF THE INVENTION

In order to solve the above-described problem, one aspect of the present invention provides an electromagnetic induction heating apparatus performing electromagnetic induction heating of a heating target electromagnetically coupled to an inductor, the electromagnetic induction heating apparatus comprising: a resonant circuit that includes the inductor and a capacitor; a direct-current electric power supply; a switching element performing ON and OFF switching of electric power supplied to the resonant circuit by the direct-current electric power supply; and a switching control unit performing intermittent control of the electric power supplied to the resonant circuit by performing control of the ON and OFF switching by the switching element at regular intervals, and by performing control to stop the electric power supplied to the resonant circuit when not performing control of the ON and OFF switching, wherein during the intermittent control, the switching control unit performs gradual control such that, upon beginning the control of the ON and OFF switching, the electric power supplied to the resonant circuit undergoes a gradual increase to reach a target value, and upon stopping the control of the ON and OFF switching, the electric power supplied to the resonant circuit undergoes a gradual decrease from the target value until stopping, and the gradual control is such that the gradual decrease is performed with fewer steps than the gradual increase.

BRIEF DESCRIPTION OF THE DRAWINGS

These and the other objects, advantages, and features of the invention will become apparent from the following description thereof taken in conjunction with the accompanying drawings which illustrate a specific embodiments of the invention.

In the drawings.

DESCRIPTION OF THE PREFERRED EMBODIMENTS

The following describes an electromagnetic induction heating device according to a preferred Embodiment of the present invention, using an example of application to a tandem colour digital printer (hereinafter simply termed a printer).

[1] Printer Configuration

Figure 1:
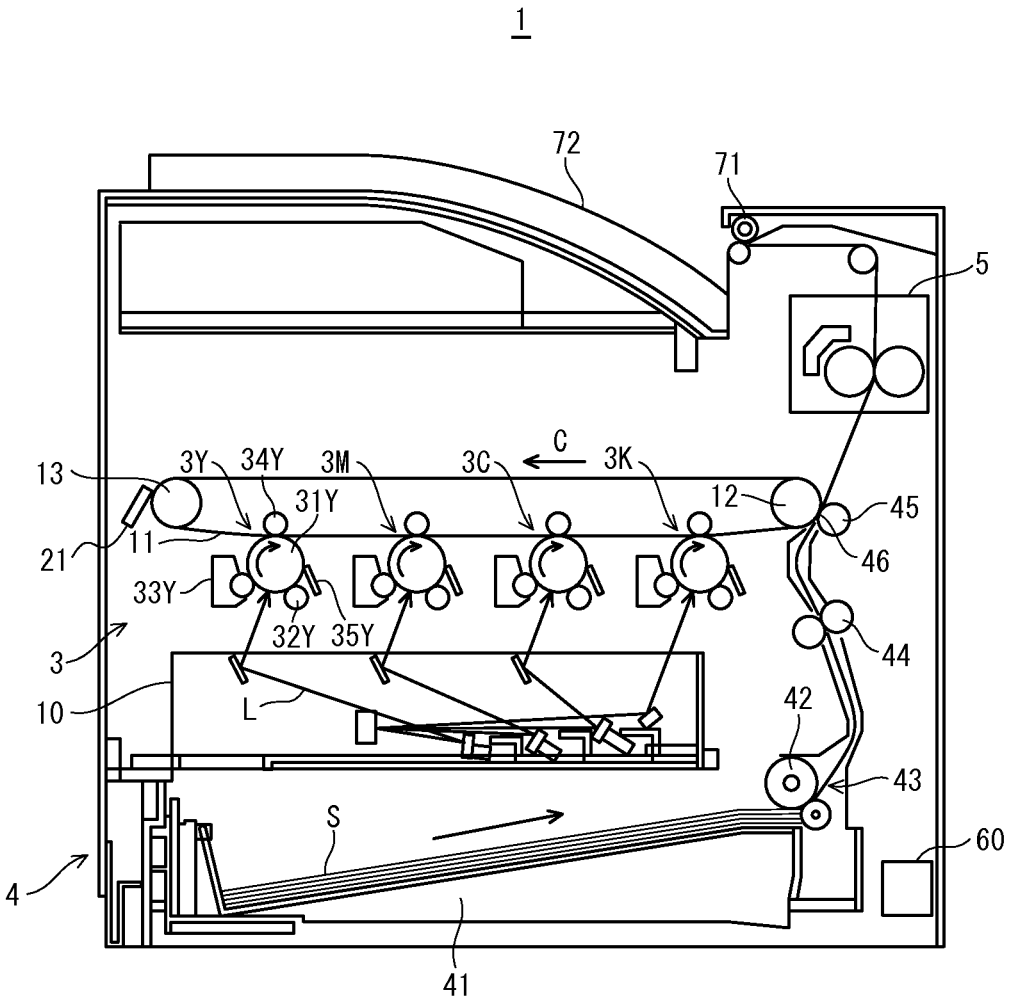
FIG. 1 illustrates the configuration of a printer.

First, the configuration of a printer pertaining to the present Embodiment is described. FIG. 1 illustrates the configuration of the printer pertaining to the present Embodiment. As shown, a printer 1 includes an image processing unit 3, a take-up unit 4, a fixing device 5, and a control unit 60.

The printer 1 is connected to a network (e.g., a LAN), receives a print instruction from a (non-diagrammed) external terminal device or from a non-diagrammed operation panel having a display, forms a toner image corresponding to the received instruction in each of yellow, magenta, cyan, and black, then creates a full-colour image on a recording sheet through overlay transfer of these images, thus executing a print process onto the recording sheet. Hereinafter, the colours yellow, magenta, cyan, and black used for reproduction are represented by the respective initials Y, M, C, and K, and components pertaining to these colours have the corresponding initials appended to the reference signs thereof.

The image processor 3 includes imaging units 3Y, 3M, 3C, and 3K, an exposure unit 10, an intermediate transfer belt 11, a secondary transfer roller 45, and so on. The imaging units 3Y, 3M, 3C, and 3K are each configured identically. As such, the following explanations mainly pertain to imaging unit 3Y as a representative example.

Imaging unit 3Y includes a photosensitive drum 31Y, a charger 32Y, a developer 33Y, a primary transfer roller 34Y, and a cleaner 35Y for cleaning the photosensitive drum 31Y, all disposed at the periphery thereof. A yellow toner image is created on the photosensitive drum 31Y. The developer 33Y faces the photosensitive drum 31Y and transports statically charged toner to the photosensitive drum 31Y. The intermediate transfer belt 11 is an endless belt overspanning a driving roller 12 and a driven roller 13 and driven to circulate in the direction indicated by arrow C. A cleaner 21 is provided in the vicinity of the driven roller 13 to remove excess toner from the intermediate transfer belt 11.

The exposure unit 10 includes a light-emitting element, which is a laser diode or similar. The exposure unit 10 produces laser light L for forming the image in the colours Y, M, C, K in accordance with a drive signal from the control unit 60 by scanning the respective photosensitive drums of the imaging units 3Y, 3M, 3C, and 3K. Exposure to the laser light L causes photosensitive drum 31Y, charged by the charger 32Y, to form a latent static image. Latent static images are likewise formed on the respective photosensitive drums of the other imaging units 3M, 3C, and 3K.

The latent static images formed on the photosensitive drums are developed by the respective developers in the imaging units 3Y, 3M, 3C, and 3K, thus forming toner images in the corresponding colours on each photosensitive drum. The toner images so formed sequentially undergo a primary transfer onto the intermediate transfer belt 11, performed by the respective primary transfer rollers of the imaging units 3Y, 3M, 3C, and 3K (FIG. 1 only indicates primary transfer roller 34Y corresponding to imaging unit 3Y, the other primary transfer rollers being omitted) with timing offset such that the images are overlaid at a common position on the intermediate transfer belt 11. Afterward, the toner images on the intermediate transfer belt 11 are transferred as one onto a recording sheet, through the effect of static electricity from the secondary transfer roller 45.

The recording sheet having the toner image thereon after the secondary transfer is further transported to the fixing device 5. There, the toner image on the recording sheet (i.e., the unfixed image) is heated and pressurized within the fixing device 5 and thereby fixed to the recording sheet. The recording sheet is then taken to an exit tray 72 by an exit roller 71.

The take-up unit 4 includes a paper feed cassette 41 containing recording sheets (represented by reference sign S in FIG. 1), a pick-up roller 42 picking up the recording sheets in the paper feed cassette 41 one by one for passage into a transport path 43, and a timing roller 44 for adjusting the timing at which each recording sheet is picked up and sent to a secondary transfer position 46.

The paper feed cassette 41 is not limited to being one in number, but may also be provided in plurality. The recording sheets may be paper sheets of varying size and thickness (i.e., regular sheets and thick sheets), overhead projector sheets, and other film sheets. When a plurality of paper feed cassettes are provided, a single paper feed cassette may contain a plurality of recording sheets that differ in terms of size, thickness, and type.

The timing roller 44 transports the recording sheet to the secondary transfer position 46, timing the arrival at the secondary transfer position 46 of the toner image that has undergone the primary transfer onto the intermediate transfer belt 11 so that the images on the intermediate transfer belt 11 arrive at the same position. Then, the toner images on the intermediate transfer belt 11 are transferred as a batch onto the recording sheet by the secondary transfer roller 45.

The pick-up roller 42, the timing roller 44, and various other rollers are powered by a (non-diagrammed) transport motor and are driven to rotate by a (non-diagrammed) power transmission mechanism that includes gears, belts, and so on. The transport motor is, for example, a step motor for which very precise rotation speed control is possible.

[2] Fixing Device Configuration

Figure 2:
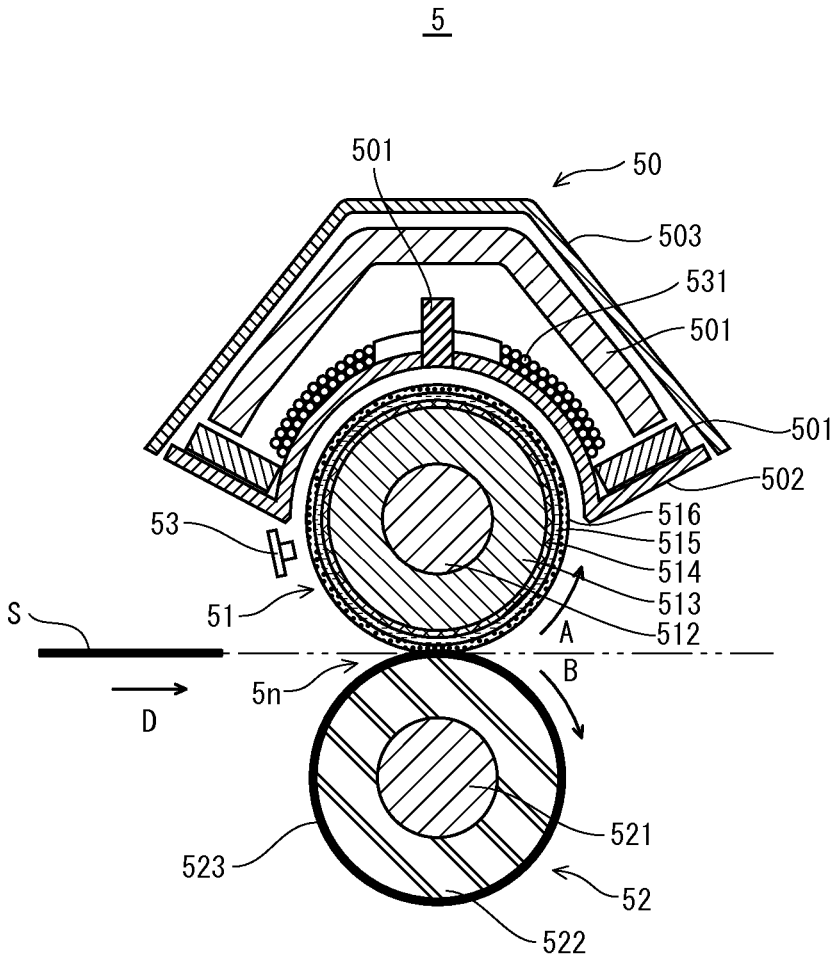
FIG. 2 shows a lateral cross-section illustrating the configuration of a fixing device.

FIG. 2 shows a lateral cross-section illustrating the configuration of a fixing device. As shown, the fixing device 5 includes an electromagnetic induction heating device 50, a fixing roller 51 that is subject to heating, a pressing roller 52, and a temperature sensor 53. The recording sheets are designated by the reference sign S. In FIG. 2, arrow A indicates the rotation direction of the fixing roller 51, arrow B indicates the rotation direction of the pressing roller 51, and arrow D indicates the transport direction of the recording sheet S.

The electromagnetic induction heating device 50 includes a non-diagrammed electromagnetic induction heating circuit, an inductor 531 electrically connected thereto, a core 501, a coil bobbin 502, a cover 503, and so on. The electromagnetic induction heating device 50 is arranged along the rotational axis direction of the fixing roller 51.

The inductor 531 extends along the width dimension of the recording sheet S and is wound around the coil bobbin 502 so as to form a crescent in lateral cross-section. High-frequency electric power is supplied to the inductor 531 from the electromagnetic induction heating circuit. Thus, magnetic flux is produced by the inductor 531 and causes electromagnetic induction heating in the fixing roller 51 (i.e., in a later-described electromagnetic induction heating layer 514). Specifically, the flux produced by the inductor 531 reaches the later-described electromagnetic induction heating layer 514 of the fixing roller 51, thus producing eddy currents in the electromagnetic induction heating layer 514 that cause electromagnetic induction heating in the electromagnetic induction heating layer 514.

The cores 501 are each made of high-permeability ferrite or the like, and serve to effectively channel the magnetic flux produced by the inductor 531 to the fixing roller 51. The coil bobbin 502 has a portion facing the outer circumferential surface of the fixing roller 51 that curves in a crescent therealong at a fixed separation (e.g., 3 mm) from the outer circumferential surface.

Figure 3:
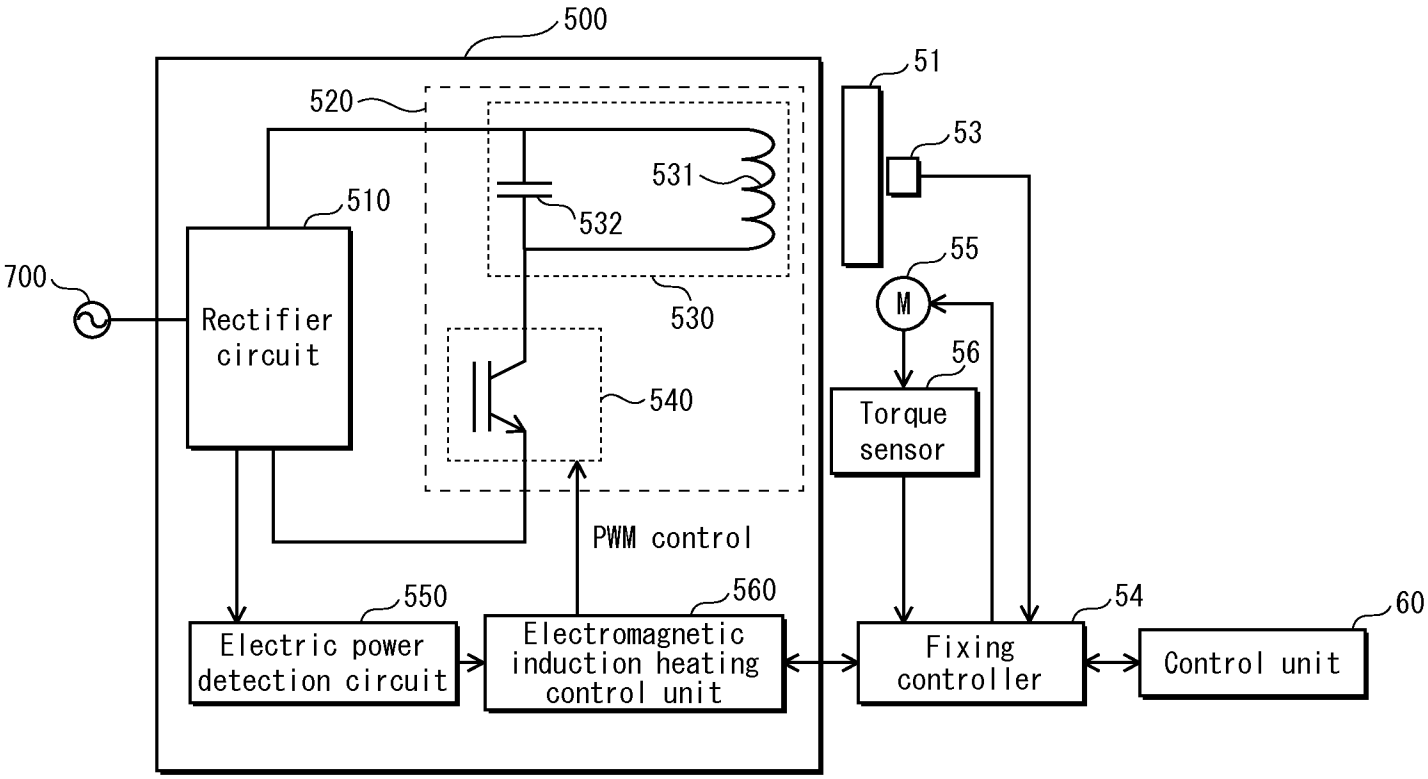
FIG. 3 is a functional block diagram indicating the relationship between an electromagnetic induction heating circuit of an electromagnetic induction heating device and the main components pertaining to control of the electromagnetic induction heating circuit.

FIG. 3 is a functional block diagram indicating the relationship between an electromagnetic induction heating circuit 500 of an electromagnetic induction heating device 50 and the main components pertaining to control of the electromagnetic induction heating circuit 500. The electromagnetic induction heating circuit 500 includes a rectifier circuit 510, an inverter circuit 520, an electric power detection circuit 550, and an electromagnetic induction heating control unit 560.

The rectifier circuit 510 rectifies alternating current supplied from a commercial power source 700 to produce direct current, and outputs the direct current to the inverter circuit 520. The inverter circuit 520 includes a resonant circuit 530 made up of the inductor 531 and a capacitor 532 connected in parallel, and a switching element 540 connected in series to the resonant circuit 530.

The inverter circuit 520 generates the high-frequency electric power from the direct current input thereto, through pulse width modulation (hereinafter, PWM) control of the switching element 540 being turned ON and OFF, performed by the electromagnetic induction heating control unit 560. The switching element 540 is switched ON and OFF by a non-diagrammed drive circuit. The electromagnetic induction heating control unit 560 controls the drive circuit to achieve PWM control of the switching element 540. The switching element 540 is, for example, an insulated gate bipolar transistor (hereinafter, IGBT), a metal oxide semiconductor field effect transistor (hereinafter, MOSFET), or other transistor. The electric power detection circuit 550 detects electric power in the rectifier circuit 510 and outputs detection results to the electromagnetic induction heating control unit 560.

The electromagnetic induction heating control unit 560 is able to communicate with a fixing control unit 54, includes a CPU, ROM, RAM, and so on, and performs PWM control of the switching element 540 according to the detection results and a value of supplied electric power as instructed by the fixing control unit 54. As such, the electric power is supplied to the inverter circuit 520 according to the instructed value, and the high-frequency electric power is generated.

The electromagnetic induction heating control unit 560 switches between intermittent PWM control and continuous PWM control of the switching element 540 according to the value instructed by the fixing control unit 54. Specifically, when the value instructed by the fixing control unit 54 is lower than a lower limit (e.g., 400 W), the electromagnetic induction heating control unit 560 performs intermittent PWM control of the switching element 540, and otherwise performs continuous PWM control of the switching element 540.

Intermittent PWM control is PWM control by the switching element 540 control involving the following: providing a PWM control stop period during which the PWM control is stopped, performing the PWM control at regular time intervals, performing control to stop electric power supply to the resonant circuit 530 of the inverter circuit 520 while PWM control is not being performed (i.e., during the PWM control stop period), and supplying power to the resonant circuit 530 as instructed by the fixing control unit 54. Such intermittent PWM control is performed in order to reduce the occurrence of switching loss in the switching element 540, which is caused when the supply of electric power is instructed to be low power.

Furthermore, sudden changes in flux occur in a period of transition, within the intermittent PWM control, from the PWM control stop period to a PWM control execution period during which the PWM control is executed on the switching element 540, and a period of transition from the PWM control execution period to the PWM control stop period. As a result, the fixing roller 51, being subject to heating, undergoes repeated deformation, thus producing noise. In order to prevent this occurrence, PWM control is performed on the switching element 540 so as to gradually change the electric power supplied to the resonant circuit 530 during the two transition periods.

Specifically, during the transition from the PWM control stop period to the PWM control execution period, the electric power supply to the resonant circuit 530 is controlled by gradually increasing the duty cycle of the PWM signal, thus causing a gradual increase until a target value is reached. Likewise, during the transition from the PWM control execution period to the PWM control stop period, the electric power supply is controlled by gradually decreasing the duty cycle, thus causing a gradual decrease until the target value is reached.

The target value is a value of supplied electric power that can realise zero-crossing control of switching the switching element 540 ON and OFF such that the applied voltage and current are approximately zero. The target value is determined in advance by the printer manufacturer in consideration of the range of supplied electric power. The electromagnetic induction heating control unit 560 stores the duty cycles for supplying the target value of electric power that corresponds to each value of supplied electric power instructed by the fixing control unit 54.

Furthermore, among the gradual controls mentioned above, the supplied electric power is gradually decreased in fewer steps (in this example, two steps) than are used to gradually increase the supplied electric power (in this example, four steps). The gradual control performed by the electromagnetic induction heating control unit 560 is hereinafter termed uneven gradual intermittent control.

The continuous PWM control is PWM control of the switching element 540 that is performed continuously without providing a stop period.

The inventors have performed the following experimental validation and thus confirmed that the uneven gradual intermittent control pertaining to the present Embodiment is effective in constraining the occurrence of switching loss and in preventing noise production when intermittent PWM control is performed.

FIGS. 4A through 4D illustrate changes in the sound pressure level of the component subject to heating and in the amount of switching loss occurring when low electric power is supplied to a resonant circuit 530 of the inverter circuit 520 through non-gradual intermittent PWM control, in which the gradual control of increasing the supplied electric power is not performed and the intermittent control is performed at regular time intervals.

Figure 4A:
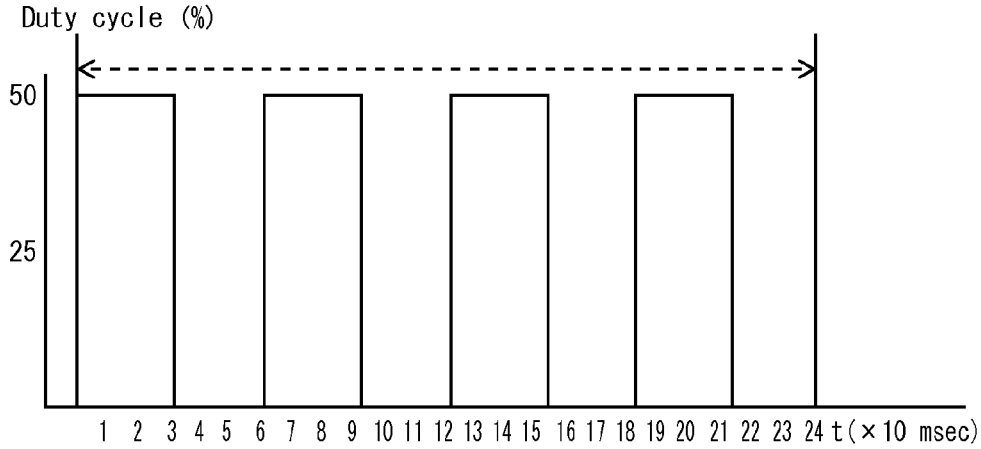
FIG. 4A illustrates a change in duty cycle over time.
Figure 4B:
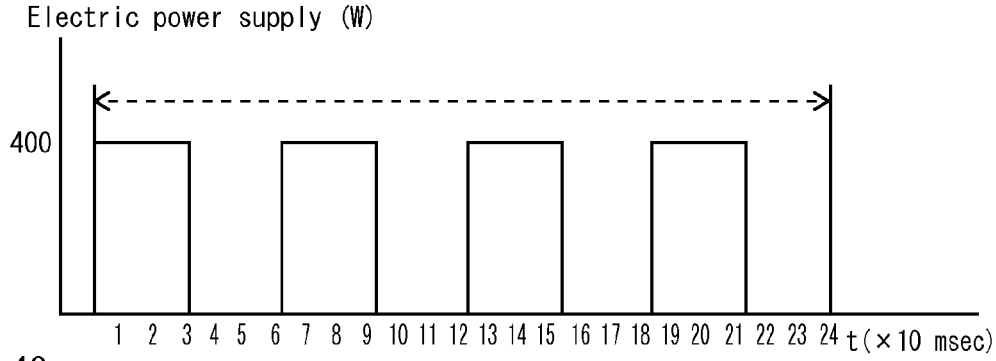
FIG. 4B illustrates a change in electric power supplied to a resonant circuit relative to the change in duty cycle over time.
Figure 4C:
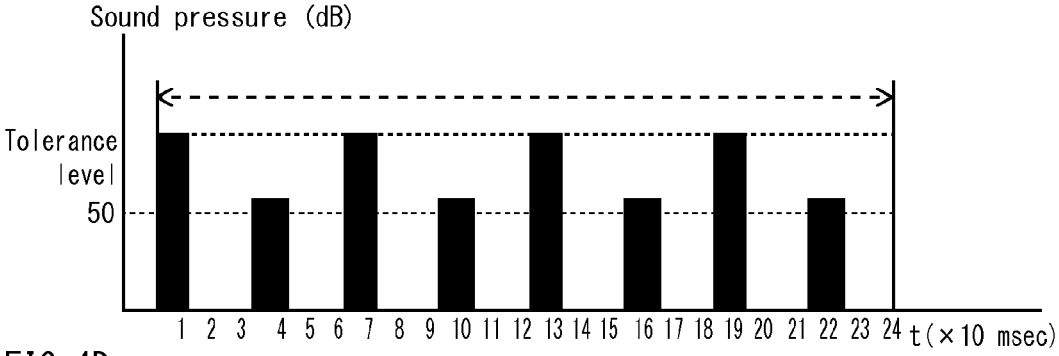
FIG. 4C illustrates a change in sound pressure level relative to the change in electric power supplied to the resonant circuit.
Figure 4D:
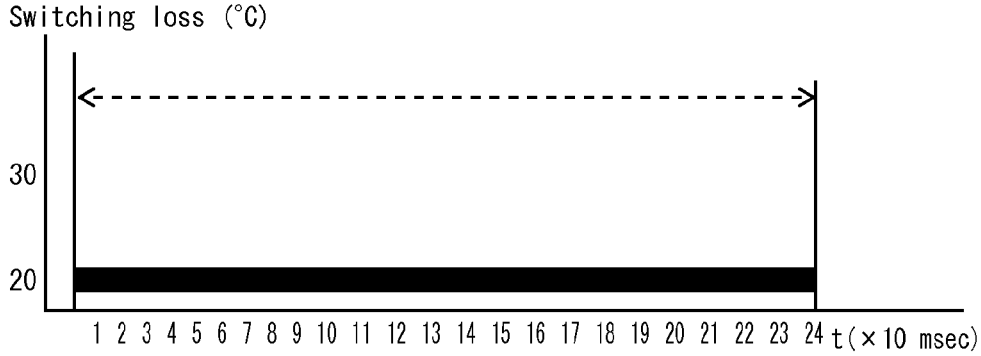
FIG. 4D illustrates a change in switching loss relative to the change in electric power supplied to the resonant circuit, when low electric power is supplied to a resonant circuit 530 of the inverter circuit 520 through non-gradual intermittent PWM control.

FIG. 4A indicates the change in duty cycle over time, FIG. 4B indicates the change in electric power supplied to the resonant circuit 530 as the duty cycle changes over time, FIG. 4C indicates the change in sound pressure level as the supplied electric power changes over time, and FIG. 4D indicates the change in switching loss as the supplied electric power changes over time. The interval spanned by the double-ended arrow in each of FIGS. 4A through 4D represents one cycle of non-gradual intermittent PWM control.

The experiment made use of a configuration identical to that of the electromagnetic induction heating device 5 pertaining to the present Embodiment. The switching loss was measured by measuring the switching element temperature using a temperature sensor. In the experiment, as shown in FIGS. 4A and 4B, PWM control is performed on the switching element at a fixed duty cycle (in this example, 50%), and electric power (in this example, 400 W) is supplied to the resonant circuit of the inverter circuit.

In such circumstances, as shown in FIG. 4D, the switching loss does not increase (i.e., no increase in switching element temperature is confirmed) and is thus prevented from occurring. However, as shown in FIG. 4C, the sound pressure level of the component subject to heating (i.e., the fixing roller) increases at the start and stop of PWM control. The sound pressure level crosses the allowable threshold (here, 50 dB) below which humans do not yet begin to perceive noise. The allowable threshold has been determined by the printer manufacturer through experimentation. Furthermore, the sound pressure level is greater when the PWM control is being started than when the PWM control is being stopped.

The inventors noticed that the sound pressure level increases differently in each situation, and considered the following. Simply making a gradual change in electric power supplied to the resonant circuit so as to prevent sudden changes in flux does not suffice to prevent the occurrence of switching loss and noise by the component subject to heating during non-gradual intermittent PWM control. As such, the inventors thought that, as discussed in the present Embodiment, a different number of steps could be provided in the PWM control performed when gradually increasing the supplied electric power and when gradually decreasing the supplied electric power, thus constraining the occurrence of switching loss and preventing noise production. The inventors thus realised an experiment comparing the change in sound pressure level and in switching loss between cases where a different number of steps is and is not provided.

FIGS. 5A through 5D illustrate changes in the sound pressure level of the component subject to heating and in the amount of switching loss occurring when low electric power is supplied to the resonant circuit of the inverter circuit through equal gradual intermittent PWM control, in which the intermittent control of gradually increasing and decreasing the supplied electric power is performed at regular time intervals with equal increases.

Figure 5A:
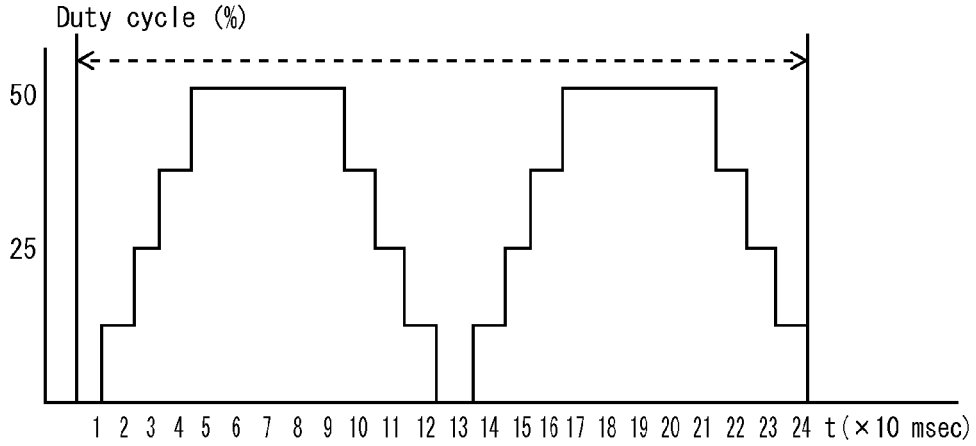
FIG. 5A illustrates a change in duty cycle over time.
Figure 5B:
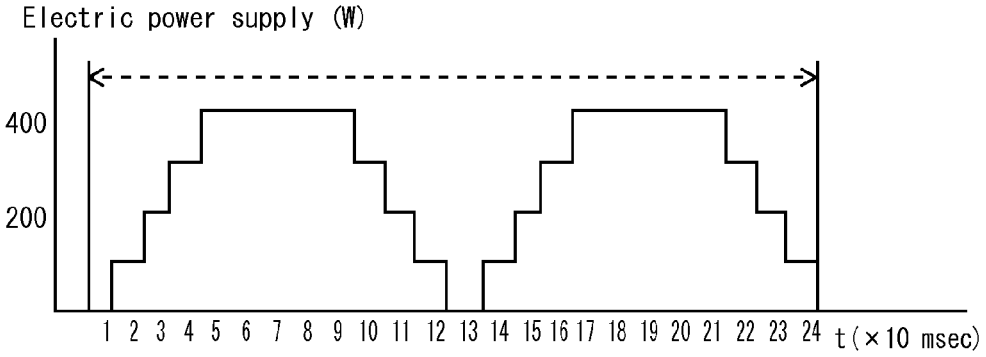
FIG. 5B illustrates a change in electric power supplied to a resonant circuit relative to the change in duty cycle over time.
Figure 5C:
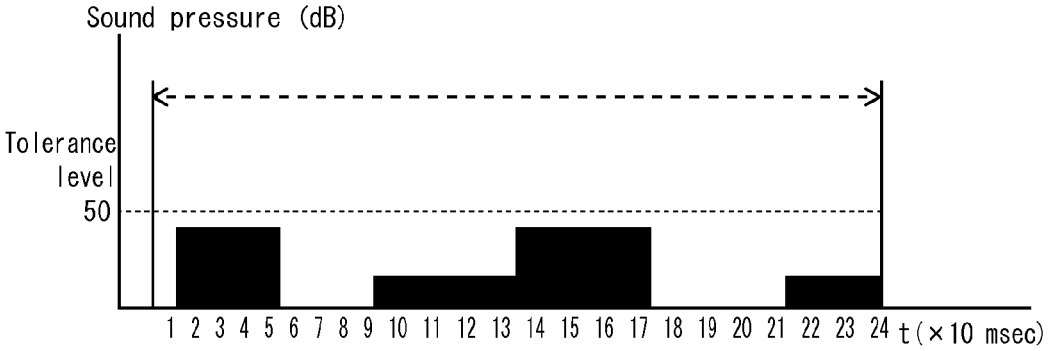
FIG. 5C illustrates a change in sound pressure level relative to the change in electric power supplied to the resonant circuit.
Figure 5D:
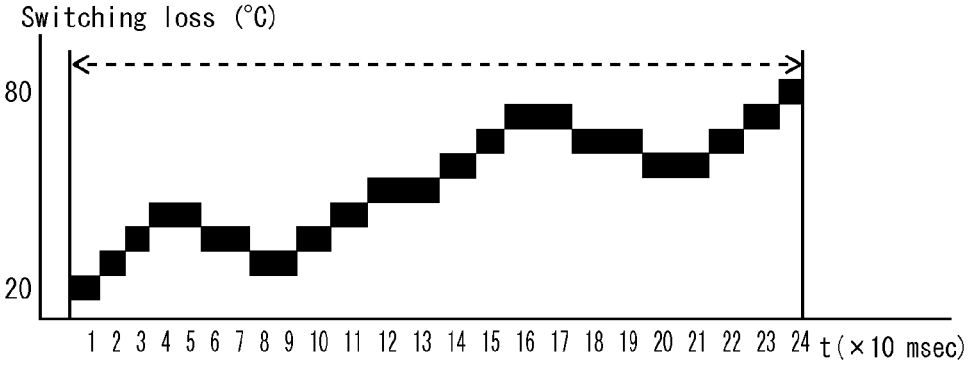
FIG. 5D illustrates a change in switching loss relative to the change in electric power supplied to the resonant circuit, when low electric power is supplied to the resonant circuit of the inverter circuit through equal gradual intermittent PWM control.

FIG. 5A indicates the change in duty cycle over time, FIG. 5B indicates the change in electric power supplied to the resonant circuit 530 as the duty cycle changes over time, FIG. 5C indicates the change in sound pressure level as the supplied electric power changes over time, and FIG. 5D indicates the change in switching loss as the supplied electric power changes over time. The interval spanned by the double-ended arrow in each of FIGS. 5A through 5D represents one cycle of non-gradual intermittent PWM control.

The experiment made use of a configuration identical to that of the electromagnetic induction heating device 5 pertaining to the present Embodiment. The switching loss was measured by measuring the switching element temperature using a temperature sensor.

As shown in FIGS. 5A and 5B, in this experiment, control is performed to gradually increase the supply of electric power to the resonant circuit until the target value is reached, by gradually increasing the duty cycle when PWM control starts. Likewise, control is performed to gradually decrease the supply of electric power until supply stops, by gradually decreasing the duty cycle when PWM control stops. Then, control is performed such that the number of steps used in the gradual increase and the gradual decrease are equal.

In such circumstances, as shown in FIG. 5C, the sound pressure level of the component subject to heating (i.e., the fixing roller) falls below the allowable threshold (here, 50 dB) at the start and stop of PWM control. This enables the prevention of noise production by the fixing roller. However, as shown in FIG. 5D, a large increase in switching loss occurs, and thus this approach does not enable the occurrence of switching loss in the switching element 540 to be decreased.

FIGS. 6A through 6D illustrate changes in the sound pressure level of the component subject to heating and in the amount of switching loss occurring when low electric power is supplied to the resonant circuit 530 of the inverter circuit 520 through unequal gradual intermittent control.

Figure 6A:
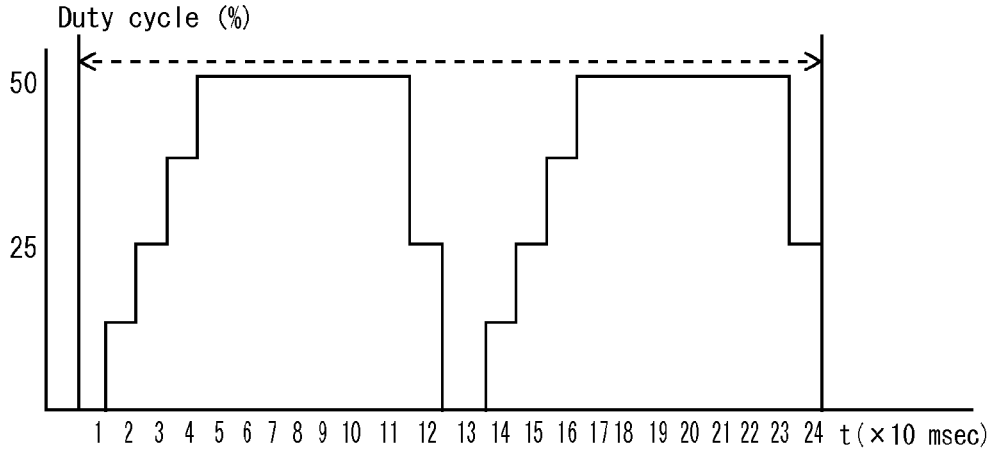
FIG. 6A illustrates a change in duty cycle over time.
Figure 6B:
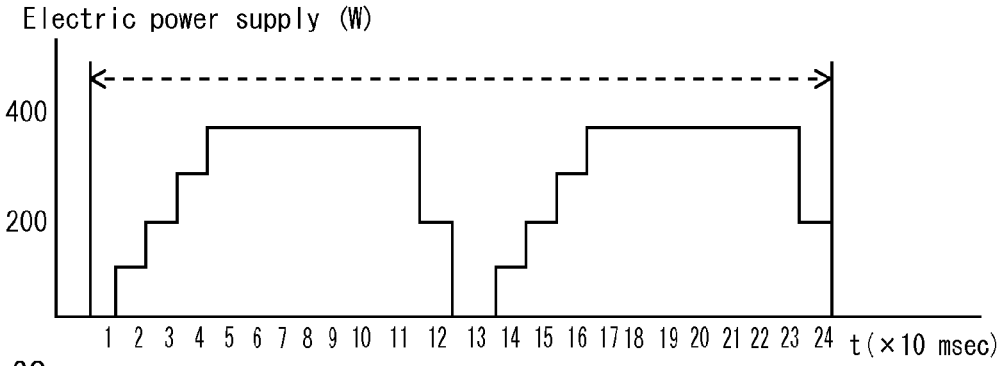
FIG. 6B illustrates a change in electric power supplied to a resonant circuit relative to the change in duty cycle over time.
Figure 6C:
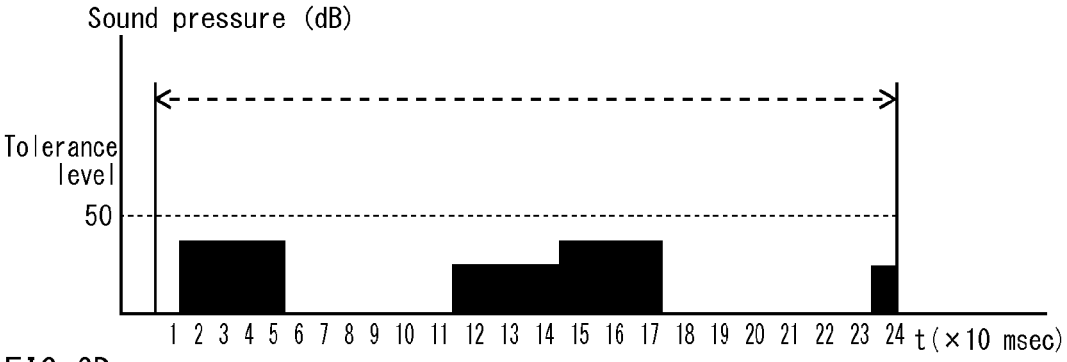
FIG. 6C illustrates a change in sound pressure level relative to the change in electric power supplied to the resonant circuit.
Figure 6D:
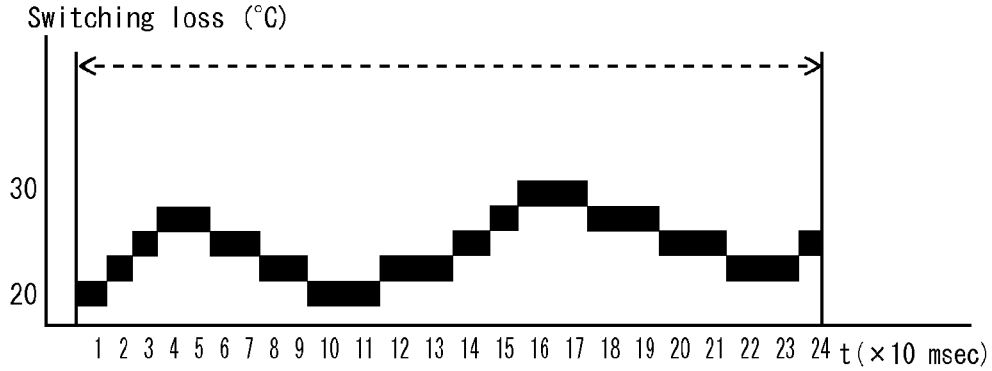
FIG. 6D illustrates a change in switching loss relative to the change in electric power supplied to the resonant circuit, when low electric power is supplied to the resonant circuit 530 of the inverter circuit 520 through unequal gradual intermittent control.

FIG. 6A indicates the change in duty cycle over time, FIG. 6B indicates the change in electric power supplied to the resonant circuit 530 as the duty cycle changes over time, FIG. 6C indicates the change in sound pressure level as the supplied electric power changes over time, and FIG. 6D indicates the change in switching loss as the supplied electric power changes over time. The interval spanned by the double-ended arrow in each of FIGS. 6A through 6D represents one cycle of unequal gradual intermittent control.

The experiment made use of the electromagnetic induction heating device 5 pertaining to the present Embodiment. The switching loss was measured by measuring the switching element temperature using a temperature sensor.

As shown in FIGS. 6A and 6B, in this experiment, control is performed to gradually increase the supply of electric power to the resonant circuit until the target value is reached, by gradually increasing the duty cycle when PWM control starts. Likewise, control is performed to gradually decrease the supply of electric power until supply stops, by gradually decreasing the duty cycle when PWM control stops. Then, control is performed such that the number of steps used in the gradual increase is greater than the number of steps used in the gradual decrease.

In such circumstances, and as shown in FIGS. 6C and 6D, the sound pressure level of the component subject to heating (i.e., the fixing roller) falls below the allowable threshold (here, 50 dB) at the start and stop of PWM control. This enables the prevention of noise production by the fixing roller, and constrains the increase in switching loss.

As such, performing the unequal gradual intermittent control pertaining to the present Embodiment enables constraint of switching loss occurrence while the control is being performed, and also prevents noise production.

The explanation of FIG. 3 is now resumed. The fixing control unit 54 includes a CPU, ROM, RAM, and so on, and performs overall control of the fixing device 5 under the further control of the control unit 60. Specifically, the fixing control unit 54 performs the following: controlling the driving of a drive motor 55 for the pressing roller 52, thus controlling the rotational drive of the fixing roller 51 and the pressing roller 52; monitoring the torque magnitude of the drive motor 55, which is detected by a torque sensor 56, to detect torque variations in the drive motor 55; determining the value of electric power supplied to the inverter circuit 520 according to a difference between a target temperature (e.g., 180° C.) and a temperature of the outer circumferential wall of the fixing roller 51, which is detected by the temperature sensor 53; and indicating that the value of electric power supply determined by the electromagnetic induction heating control unit 560 is to be supplied to the inverter circuit 520.

The control unit 60 includes a CPU, ROM, RAM, and so on, and is able to communicate with the fixing control unit 54. The control unit 60 performs overall control of the printer 1, and controls the fixing device 5 via the fixing control unit 54. Instead of using the torque sensor 56, the variations in torque may, for example, be detected by detecting variations in the current supplied to the drive motor 55.

The explanation of FIG. 2 is now resumed. The fixing roller 51 includes a core bar 512 that is cylindrical in a longitudinal axis, and a resilient layer 513 the electromagnetic induction heating layer 514, a resilient body 515, and a release layer 516, each layered in the stated order at the outer circumferential surface of the core bar 512.

The core bar 512 serves as a support member for the fixing roller 51, and is configured as a cylinder, for example. The material used for the core bar 512 is, for example, aluminium, iron, stainless steel, or similar. The resilient layer 513 ensures that heat produced by the electromagnetic induction heating layer 514 is not transmitted to the core bar 512. As shown in FIG. 2, the resilient layer 513 forms a fixing nip 5*n* with the pressing roller 52. The resilient layer 513 is beneficially made of a material that is thermally insulating and heat-resistant, such as silicone rubber, fluororubber, or similar foamed resilient material.

The electromagnetic induction heating layer 514 is made of nickel or the like, and is heated by magnetic flux produced by the inductor 531. The resilient body 515 serves to transmit heat smoothly and evenly to the toner image on the recording sheet. The resilient body 515 is provided to prevent the toner image from being crushed or from being fused unevenly, as well as to prevent the occurrence of image noise. The resilient body 515 is made of a material that is resilient and heat-resistant, such as rubber or resin. For example, silicone rubber or fluororubber may be used.

The release layer 516 is the outermost layer of the fixing roller 51 and serves to increase the separation between the fixing roller 51 and the recording sheet. The material for the release layer 516 is beneficially able to withstand fixing temperatures, and to provide release for the toner. For example, a fluorocarbon polymer such as PFA (a tetrafluroethylene-perfluoroalkoxyethylene compound), PFTA (polytetrafluoroethylene), FEP (a tetrafluoroethylene-heptafluoroethylene compound), PFEP (a tetrafluoroethylene-heptafluoropropylene compound), and so on may be used.

The pressing roller 52 is made up of a cylindrical core bar 521 having a resilient body 522 and a release layer 523 layered thereon, and presses the fixing roller 51 such that the fixing nip 5*n* is formed with a predetermined width between the outer circumferential surface of the fixing roller 51 and the pressing roller 52. The pressing roller 52 is driven by the drive motor 55 to rotate in direction B as indicated in FIG. 2, while the fixing roller 51 rotates passively in direction A, also shown in FIG. 2.

The core bar 521 serves as a supporting member for the pressing roller 52 and is made of a material that is heat-resistant and durable. The material used for the core bar 521 is, for example, aluminium, iron, stainless steel, or similar.

The resilient body 522 is made of silicone rubber, fluororubber, or similar resilient material that is highly heat-resistant. The release layer 523 serves to separate the pressing roller 52 and the recording sheet and is configured with similar materials and dimensions as the release layer 516.

[3] Electric Power Supply Control Process

Figure 7:
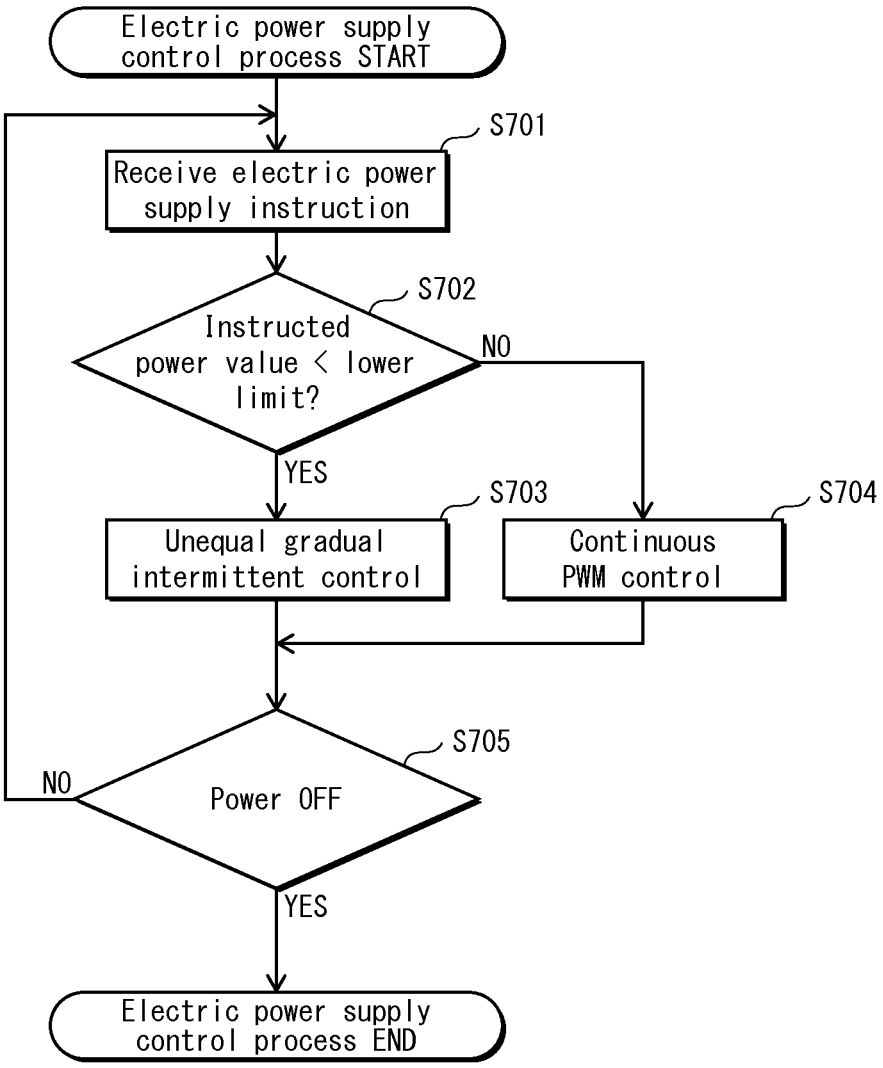
FIG. 7 is a flowchart indicating an electric power supply control process performed by an electromagnetic induction heating control unit on the resonant circuit.

FIG. 7 is a flowchart indicating an electric power supply control process performed by an electromagnetic induction heating control unit 560 on the resonant circuit 530. Upon receiving an electric power supply instruction from the fixing control unit 54 (step S701), the electromagnetic induction heating control unit 560 makes a determination regarding whether or not an instructed value for the electric power supply (hereinafter, instructed power value) is lower than a lower threshold value (i.e., 400 W) (step S702).

When the instructed power value is lower than the lower threshold (YES in step S702), the electromagnetic induction heating control unit 560 performs unequal gradual intermittent control (step S703). When the instructed power value is not lower than the lower threshold (NO in step S702), the electromagnetic induction heating control unit 560 performs continuous PWM control (step S704).

The electromagnetic induction heating control unit 560 then repeats steps S701 through S704 until the power supply of the electromagnetic induction heating circuit 500 is turned off (YES in step S705).

(Variations)

Although an Embodiment of the present invention has been described above, no limitation is intended thereto. The following variations are also possible.

(1) In the present Embodiment, performing the unequal gradual intermittent control involves changing the electric power supplied to the resonant circuit 530 by changing the duty cycle of the PWM signal. However, rather than changing the duty cycle, the unequal gradual intermittent control may involve changing the electric power supplied to the resonant circuit 530 by changing the frequency of the PWM signal.

(2) In the present Embodiment, the unequal gradual intermittent control is performed by a parallel resonant circuit in which the inductor 531 and the capacitor 532 are connected in parallel. However, the unequal gradual intermittent control pertaining to the present Embodiment may also be performed when a series resonant circuit, having an inductor and a capacitor connected in series, supplies low electric power. Effects identical to those described in the Embodiment are achievable in such a case.

(3) In the present Embodiment, the unequal gradual intermittent control is constantly performed when low electric power is supplied to the resonant circuit 530. However, the intermittent control for gradual control in accordance with the noise level of the component subject to heating (i.e., the fixing roller 51) and the intermittent control for not performing gradual control may be switched when low electric power is being supplied.

Specifically, the unequal gradual intermittent control may be performed when the sound pressure level surpasses the allowable threshold. In contrast, when the allowable threshold is not surpassed, then as shown in FIG. 4, the electric power is supplied to the resonant circuit 530 through normal intermittent control, without gradual control.

Accordingly, electric power is supplied to the resonant circuit through the normal intermittent control process when the sound pressure level does not surpass the allowable threshold, despite the supplied electric power being low. As such, switching loss is reduced in comparison to cases where unequal gradual intermittent control is performed uniformly.

The method for measuring the sound pressure level may, for instance, involve detecting the torque magnitude in the drive motor 55 through the torque sensor 56, installing a condenser microphone in the vicinity of the fixing roller 51 and detecting the volume therewith, estimating the sound pressure level produced by monitoring the electric power supply value instructed by the fixing control unit 54, and so on. These methods enable the sound pressure level of the component subject to heating (i.e., the fixing roller 51) to be indexed, thus obtaining an index value.

Figure 8:
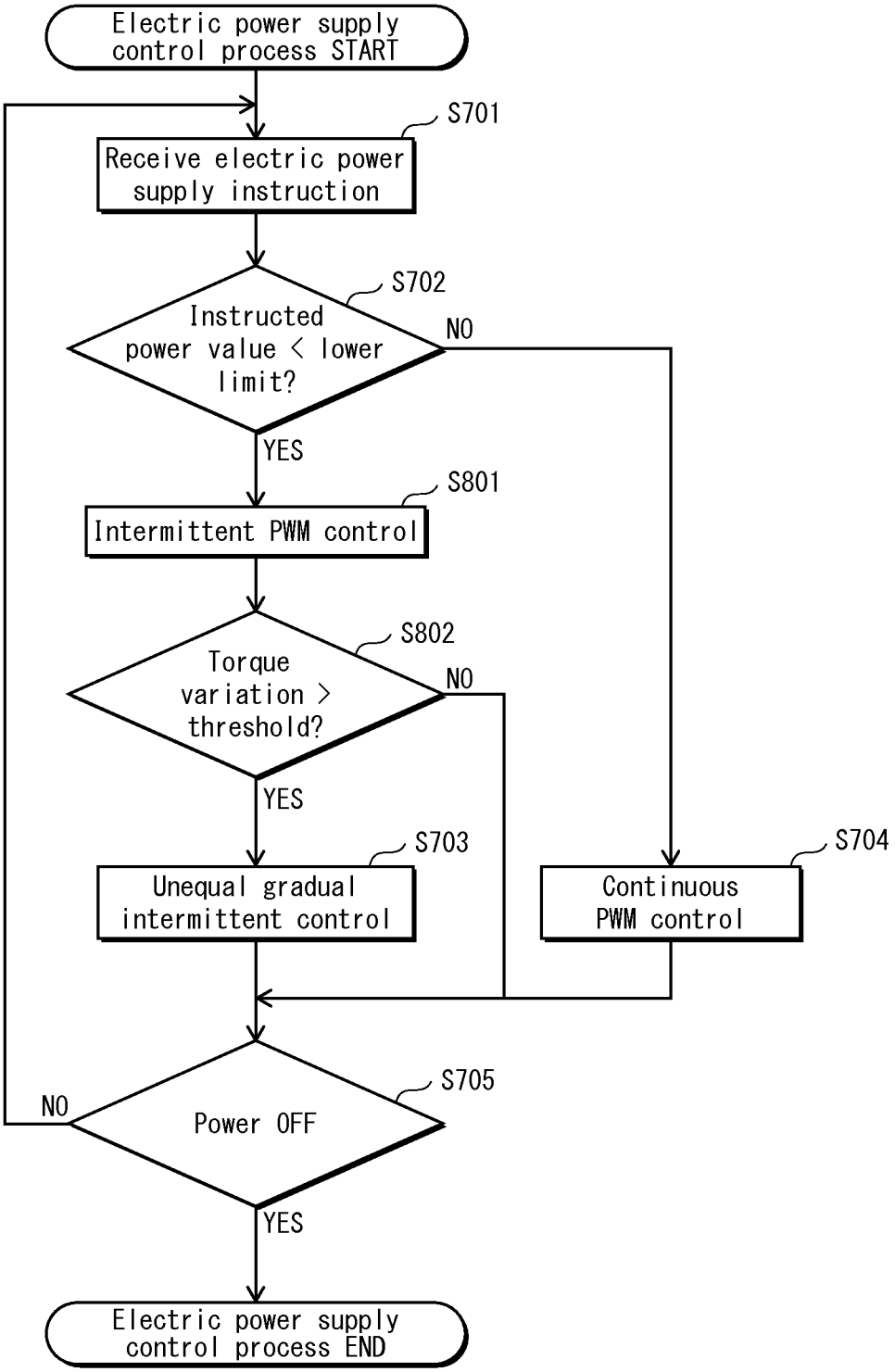
FIG. 8 is a flowchart indicating a variant electric power supply control process performed by an electromagnetic induction heating control unit on the resonant circuit.

FIG. 8 is a flowchart indicating the operations of an electric power supply control process performed by the electromagnetic induction heating control unit 560 on the resonant circuit 530, pertaining to the above-described Embodiment. As shown, steps of the process that are identical to the electric power supply control process described by FIG. 7 use the same step reference numbers. The following explanation centres on points of difference from the electric power supply control process of FIG. 7.

When the result of step S702 is affirmative (YES in step S702), the electromagnetic induction heating control unit 560 performs intermittent PWM control of performing, at regular intervals, PWM control on the switching element 540 at a regular duty cycle (e.g., 50%) (step S801). Then, the electromagnetic induction heating control unit 560 uses the torque sensor 56 to detect the variations in torque of the drive motor 55 when the PWM control on the switching element 540 begins, and accordingly determines whether or not the detected variations in torque exceed a threshold (step S802). Here, the threshold is determined in advance by the printer manufacturer, and is a value corresponding to the variation in torque occurring in the drive motor 55 when the sound pressure level of the component subject to heating (i.e., the fixing roller 51) reaches the allowable noise threshold.

When the variation in torque does not exceed the threshold (NO in step S802), the electromagnetic induction heating control unit 560 continues the intermittent PWM control. When the variation in torque exceeds the threshold (YES in step S802)m the electromagnetic induction heating control unit 560 switches the control to unequal gradual intermittent control and accordingly supplies electric power to the resonant circuit 530.

(4) In the present Embodiment, for example, when low electric power is supplied to the resonant circuit 530, the temperature at the outer circumferential surface of the fixing roller 51, which is the component subject to heating, is controlled so as to remain no lower than a predetermined temperature (e.g., 40° C.) above the fixing temperature (e.g., 180° C.). When the user makes a print job execution instruction, the temperature of the fixing roller 51 is increased by the predetermined temperature in a short time. As such, a stand-by state or similar is likely to be in use to enable print job execution.

Also, when a print job is executed, the sounds of the image formation process in operation are likely to prevent the user from hearing any noise produced, even in the absence of unequal gradual intermittent control. As such, the unequal gradual intermittent control is performed when the fixing device 5 is in a stand-by state as described above. Also, when the print job is being executed, the unequal gradual intermittent control is stopped and the intermittent PWM control of Variation (3) is performed. Specifically, state information indicating the state of the fixing device 5 is monitored by the control unit 60. When the result of step S702 from FIG. 7 is affirmative (YES in step S702), the electromagnetic induction heating control unit 560 acquires the state information monitored by the control unit 60 through the fixing control unit 54 and performs the above-described operations.

Accordingly, switching loss is reduced when the print job is executed.

The above-described variation may be similarly applied to Variation (3). Specifically, in step S802, the intermittent PWM control is continued when the print job is executed, even when the variations in torque exceed the threshold. The above-described variation may be similarly applied to Variation (5), discussed below.

(5) In the present Embodiment, the electromagnetic induction heating control unit 560 executes the intermittent PWM control of performing PWM control of the switching element 540 when the instructed value of electric power supply (i.e., the instructed power value) from the fixing control unit 54 is below the threshold. However, the intermittent PWM control may also be performed when the value is not below the threshold. The same applies to Variations (1) through (4).

Figure 9:
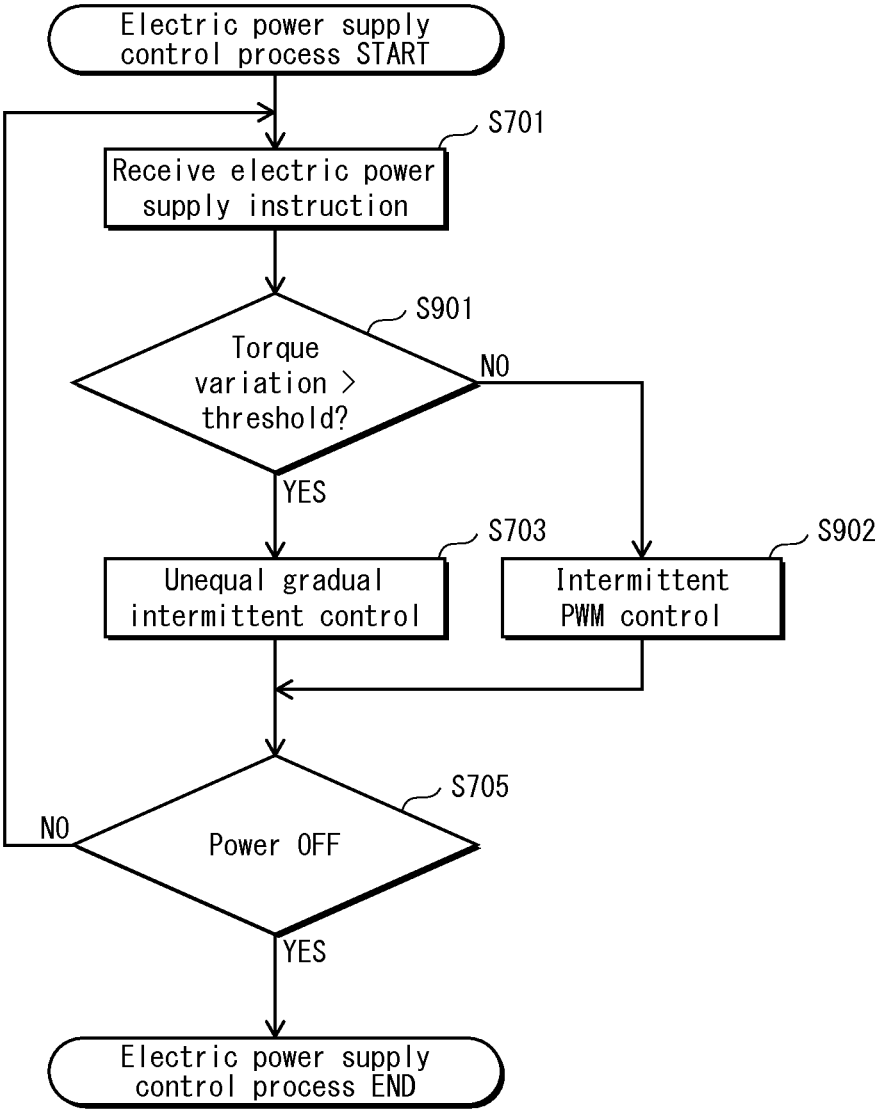
FIG. 9 is a flowchart indicating a variant electric power supply control process performed by an electromagnetic induction heating control unit on the resonant circuit.
Figure 10:
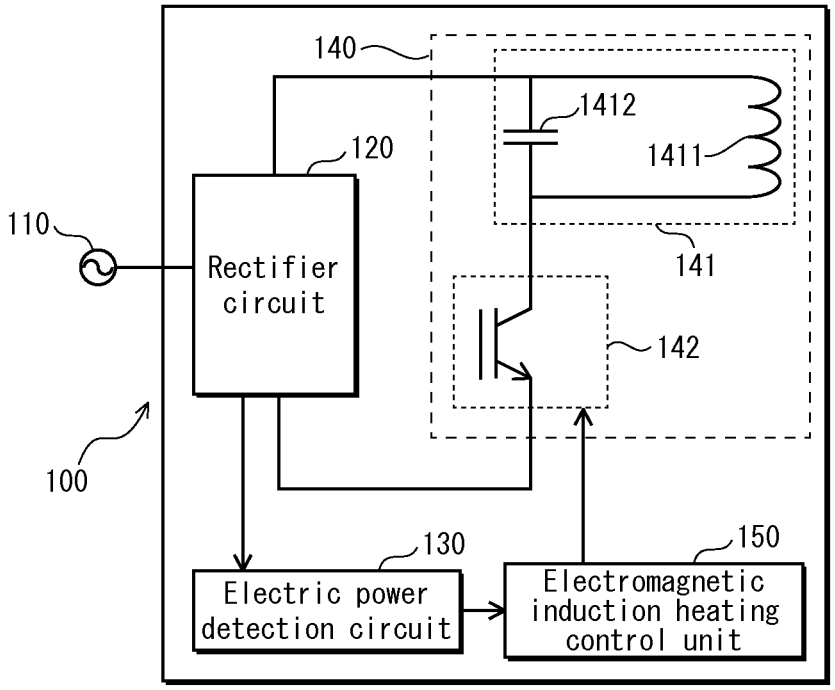
FIG. 10 illustrates a specific example of an electromagnetic induction heating device for an image formation apparatus using a conventional electromagnetic induction heating method.
Figure 11:
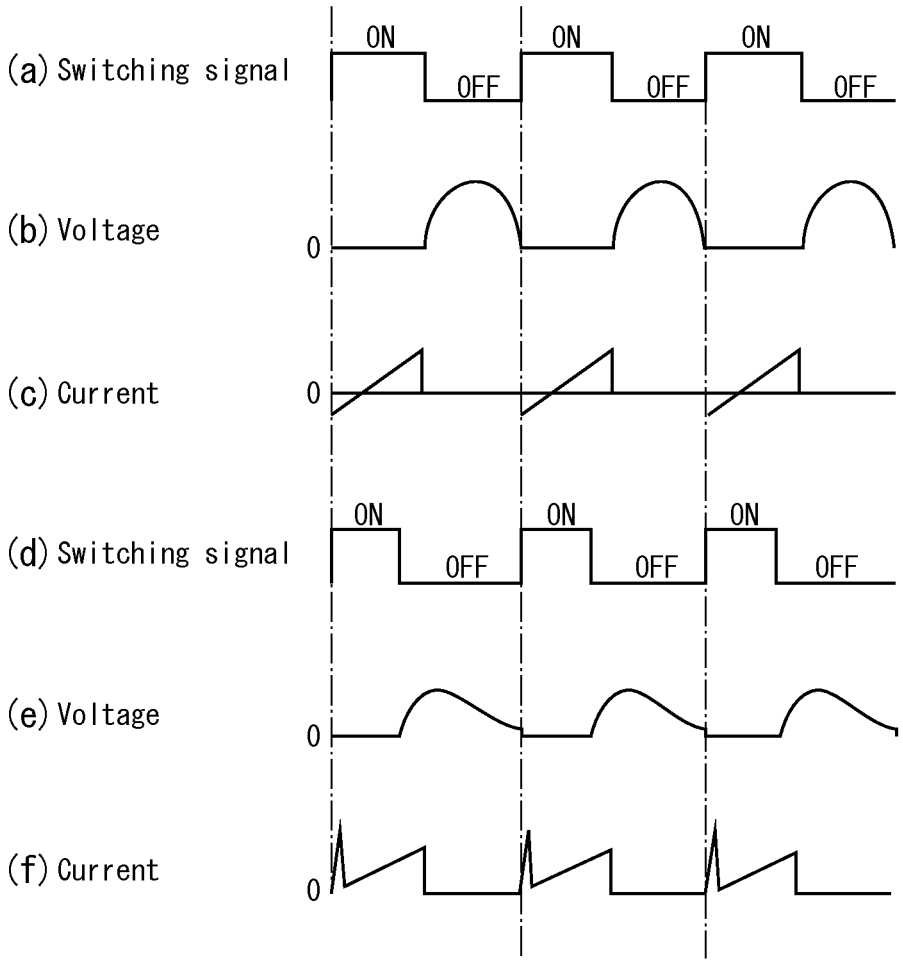
FIG. 11 Prior Art
FIG. 11 illustrates the relationships between voltage and current applied to the switching element when the switching element is switched ON and OFF during PWM control.

Also, the electric power supply control process indicated in FIG. 8 for Variation (3) may be modified as shown in FIG. 9. Steps of the process that are identical to the electric power supply control process described by FIG. 7 use the same step reference numbers. The following explanation centres on points of difference from the electric power supply control process of FIG. 8.

Upon receiving an instruction in step S701 from the fixing control unit 54 regarding the value of supplied electric power, the electromagnetic induction heating control unit 560 executes intermittent PWM control for supplying the indicated electric power to the resonant circuit. Then, the electromagnetic induction heating control unit 560 detects the variation in torque of the drive motor 55 via the torque sensor 56 at the start of the PWM control of the switching element 540, and determines whether or not the detected variations in torque exceed the threshold (step S901). The threshold used in step S901 has the same value as the threshold used in step S802 of FIG. 8.

When the variation in torque does not exceed the threshold (NO in step S901), the electromagnetic induction heating control unit 560 continues the intermittent PWM control (step S902). When the variation in torque exceeds the threshold (YES in step S901), the electromagnetic induction heating control unit 560 switches the control to unequal gradual intermittent control and accordingly supplies electric power to the resonant circuit 530 (step S703).

The determination of step S901 is not limited to detecting torque in order to detect the sound pressure level, provided that a determination of whether or not the sound pressure level exceeds the allowable tolerance can be made. For example, a condenser microphone may be installed in the vicinity of the component subject to heating (i.e., the fixing roller 51) and the volume detected thereby may be used to estimate the sound pressure level produced by the component in order to make the determination.

(6) In the present Embodiment, the fixing roller 51 is used as a component subject to heating that is electromagnetically connected to the inductor 531. However, the component subject to heating is not limited to being the fixing roller 51. For example, the component subject to heating may be an endless heating belt including the electromagnetic induction heating layer 514, the resilient body 515, and the release layer 516 of the present Embodiment. The same applies to Variations (1) through (5).

CONCLUSION

In one aspect, an electromagnetic induction heating apparatus performing electromagnetic induction heating of a heating target electromagnetically coupled to an inductor, the electromagnetic induction heating apparatus of the present disclosure comprising: a resonant circuit that includes the inductor and a capacitor; a direct-current electric power supply; a switching element performing ON and OFF switching of electric power supplied to the resonant circuit by the direct-current electric power supply; and a switching control unit performing intermittent control of the electric power supplied to the resonant circuit by performing control of the ON and OFF switching by the switching element at regular intervals, and by performing control to stop the electric power supplied to the resonant circuit when not performing control of the ON and OFF switching, wherein during the intermittent control, the switching control unit performs gradual control such that, upon beginning the control of the ON and OFF switching, the electric power supplied to the resonant circuit undergoes a gradual increase to reach a target value, and upon stopping the control of the ON and OFF switching, the electric power supplied to the resonant circuit undergoes a gradual decrease from the target value until stopping, and the gradual control is such that the gradual decrease is performed with fewer steps than the gradual increase.

Here, when the electric power supplied to the resonant circuit falls below a predetermined value, the switching control unit performs the intermittent control, and performs the gradual control while performing the intermittent control.

Also, the heating target is a heating roller in a fixing device thermally fixing an unfixed image to a recording sheet by pressing the recording sheet, during the intermittent control, the switching control unit performs the gradual control when the fixing device is in a stand-by state where a temperature of the heating target is controlled to not decrease by more than a predetermined temperature range from a fixing temperature, and when the fixing device is in a print job execution state, the switching control unit inhibits the gradual control and performs non-gradual control such that, upon beginning the control of the ON and OFF switching, the electric power supplied to the resonant circuit undergoes a one-step increase to reach the target value, and upon stopping the control of the ON and OFF switching, the electric power supplied to the resonant circuit undergoes a one-step decrease from the target value until stopping.

Here, the inductor and the capacitor of the resonant circuit are connected in parallel. Also, the switching control unit performs pulse-width modification control of the switching element, and performs the gradual control by changing a duty cycle of a pulse width modification signal.

In another aspect, a fixing device pertaining to the disclosure includes a fixing device having an electromagnetic induction heating device. In an alternative aspect, an image formation device pertaining to the disclosure includes the fixing device.

Furthermore, a switching control method pertaining to the present disclosure and used by an electromagnetic induction heating apparatus performing electromagnetic induction heating of a heating target electromagnetically coupled to an inductor, and comprising a resonant circuit including the inductor connected to a capacitor, a direct-current electric power supply, and a switching element performing ON and OFF switching of electric power supplied to the resonant circuit by the direct-current electric power supply, the switching control method comprising: an intermittent control step of performing intermittent control of the electric power supplied to the resonant circuit by performing control of the ON and OFF switching by the switching element at regular intervals in order to reduce switching loss to the resonant circuit, and by performing control to stop the electric power supplied to the resonant circuit when not performing control of the ON and OFF switching; and a gradual control step of, during the intermittent control, upon beginning the control of the ON and OFF switching, the electric power supplied to the resonant circuit undergoing a gradual increase to reach a target value, and upon stopping the control of the ON and OFF switching, the electric power supplied to the resonant circuit undergoing a gradual decrease from the target value until stopping, wherein the gradual control is such that the gradual decrease is performed with fewer steps than the gradual increase.

According to the above-described configuration, when the intermittent control is performed in order to reduce switching loss in the resonant circuit, the supplied electric power undergoes a gradual increase or decrease upon beginning or stopping the ON and OFF control of the switching element. As such, the change in electric power supplied at the beginning or the stopping of the ON and OFF control is reduced, and the production of noise that accompanies a large change in electric power is diminished.

In addition, given that the noise is produced most at the beginning of the ON and OFF control, the number of steps involved in the gradual increase is controlled so as to be greater than the number of steps involved in the gradual decrease, and so that the change in electric power at the beginning of the control is smaller than the change at the stopping of the control. Thus, noise reduction is performed efficiently in response to the noise level. Furthermore, the duration for stopping of the gradual control causing the switching loss is made shorter by the reduction in the number of steps. As such, this constrains the switching loss that is prone to occurring when the supplied electric power is low.

Also, a monitoring unit monitoring an index value indicating an acoustic pressure level of sound produced by the heating target, wherein when initiating the intermittent control, the switching control unit inhibits the gradual control and performs non-gradual control such that, upon beginning the control of the ON and OFF switching, the electric power supplied to the resonant circuit undergoes a one-step increase to reach the target value, and upon stopping the control of the ON and OFF switching, the electric power supplied to the resonant circuit undergoes a one-step decrease from the target value until stopping, during the non-gradual control, when the index value exceeds an allowable level corresponding to an allowable upper threshold of noise, the switching control unit inhibits the non-gradual control and starts the gradual control, and the switching control unit continues the non-gradual control as long as the allowable level is not exceeded.

In addition, the index value is a torque magnitude of a drive source driving the heating target.

According to the above, the sound pressure level produced by the heating target is monitored, and as long as the sound pressure level does not exceed the allowable tolerance level, the gradual control is inhibited and the non-gradual control is performed despite the non-gradual control having been performed to make a one-step change of the supplied electric power to the target value when beginning or stopping the ON and OFF control of the switching element. Thus, control is performed so as not to increase the switching loss incurred by executing unnecessary gradual control, and the occurrence of switching loss during the intermittent control is correspondingly suppressed.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. An electromagnetic induction heating apparatus performing electromagnetic induction heating of a heating target electromagnetically coupled to an inductor, the electromagnetic induction heating apparatus comprising:

a resonant circuit that includes the inductor and a capacitor;

a direct-current electric power supply;

a switching element performing ON and OFF switching of electric power supplied to the resonant circuit by the direct-current electric power supply; and a switching control unit performing intermittent control of the electric power supplied to the resonant circuit by performing control of the ON and OFF switching by the switching element at regular intervals, and by performing control to stop the electric power supplied to the resonant circuit when not performing the control of the ON and OFF switching, wherein during the intermittent control, the switching control unit performs gradual control such that, upon beginning the control of the ON and OFF switching, the electric power supplied to the resonant circuit undergoes a gradual increase to reach a target value, and upon stopping the control of the ON and OFF switching, the electric power supplied to the resonant circuit undergoes a gradual decrease from the target value until stopping, and the gradual control is such that the gradual decrease is performed with fewer steps than the gradual increase.

2. The electromagnetic induction heating apparatus of claim 1, further comprising:

a monitoring unit monitoring an index value indicating an acoustic pressure level of sound produced by the heating target, wherein when initiating the intermittent control, the switching control unit inhibits the gradual control and performs non-gradual control such that, upon beginning the control of the ON and OFF switching, the electric power supplied to the resonant circuit undergoes a one-step increase to reach the target value, and upon stopping the control of the ON and OFF switching, the electric power supplied to the resonant circuit undergoes a one-step decrease from the target value until stopping, during the non-gradual control, when the index value exceeds an allowable level corresponding to an allowable upper threshold of noise, the switching control unit inhibits the non-gradual control and starts the gradual control, and the switching control unit continues the non-gradual control as long as the allowable level is not exceeded.

3. The electromagnetic induction heating apparatus of claim 2, wherein the index value is a torque magnitude of a drive source driving the heating target.

4. The electromagnetic induction heating apparatus of claim 1, wherein when the electric power supplied to the resonant circuit falls below a predetermined value, the switching control unit performs the intermittent control, and performs the gradual control while performing the intermittent control.

5. The electromagnetic induction heating apparatus of claim 1, wherein the heating target is a heating roller in a fixing device thermally fixing an unfixed image to a recording sheet by pressing the recording sheet, during the intermittent control, the switching control unit performs the gradual control when the fixing device is in a stand-by state where a temperature of the heating target is controlled to not decrease by more than a predetermined temperature range from a fixing temperature, and when the fixing device is in a print job execution state, the switching control unit inhibits the gradual control and performs non-gradual control such that, upon beginning the control of the ON and OFF switching, the electric power supplied to the resonant circuit undergoes a one-step increase to reach the target value, and upon stopping the control of the ON and OFF switching, the electric power supplied to the resonant circuit undergoes a one-step decrease from the target value until stopping.

6. The electromagnetic induction heating apparatus of claim 1, wherein the inductor and the capacitor of the resonant circuit are connected in parallel.

7. The electromagnetic induction heating apparatus of claim 1, wherein the switching control unit performs pulse-width modification control of the switching element, and performs the gradual control by changing a duty cycle of a pulse width modification signal.

8. A fixing device performing electromagnetic induction heating of a heating target electromagnetically coupled to an inductor, the fixing device comprising:

a resonant circuit that includes the inductor and a capacitor;

a direct-current electric power supply;

a switching element performing ON and OFF switching of electric power supplied to the resonant circuit by the direct-current electric power supply; and a switching control unit performing intermittent control of the electric power supplied to the resonant circuit by performing control of the ON and OFF switching by the switching element at regular intervals, and by performing control to stop the electric power supplied to the resonant circuit when not performing the control of the ON and OFF switching, wherein during the intermittent control, the switching control unit performs gradual control such that, upon beginning the control of the ON and OFF switching, the electric power supplied to the resonant circuit undergoes a gradual increase to reach a target value, and upon stopping the control of the ON and OFF switching, the electric power supplied to the resonant circuit undergoes a gradual decrease from the target value until stopping, and the gradual control is such that the gradual decrease is performed with fewer steps than the gradual increase.

9. The fixing device of claim 8, further comprising:

a monitoring unit monitoring an index value indicating an acoustic pressure level of sound produced by the heating target, wherein when initiating the intermittent control, the switching control unit inhibits the gradual control and performs non-gradual control such that, upon beginning the control of the ON and OFF switching, the electric power supplied to the resonance circuit undergoes a one-step increase to reach the target value, and upon stopping the control of the ON and OFF switching, the electric power supplied to the resonance circuit undergoes a one-step decrease from the target value until stopping, during the non-gradual control, when the index value exceeds an allowable level corresponding to an allowable upper threshold of noise, the switching control unit inhibits the non-gradual control and starts the gradual control, and the switching control unit continues the non-gradual control as long as the allowable level is not exceeded.

10. The fixing device of claim 9, wherein the index value is a torque magnitude of a drive source driving the heating target.

11. An image formation apparatus performing electromagnetic induction heating of a heating target electromagnetically coupled to an inductor, the image formation apparatus comprising:

a resonant circuit that includes the inductor and a capacitor;

a direct-current electric power supply;

a switching element performing ON and OFF switching of electric power supplied to the resonant circuit by the direct-current electric power supply; and a switching control unit performing intermittent control of the electric power supplied to the resonant circuit by performing control of the ON and OFF switching by the switching element at regular intervals, and by performing control to stop the electric power supplied to the resonant circuit when not performing the control of the ON and OFF switching, wherein during the intermittent control, the switching control unit performs gradual control such that, upon beginning the control of the ON and OFF switching, the electric power supplied to the resonant circuit undergoes a gradual increase to reach a target value, and upon stopping the control of the ON and OFF switching, the electric power supplied to the resonant circuit undergoes a gradual decrease from the target value until stopping, and the gradual control is such that the gradual decrease is performed with fewer steps than the gradual increase.

12. The image formation apparatus of claim 11, further comprising:

a monitoring unit monitoring an index value indicating an acoustic pressure level of sound produced by the heating target, wherein when initiating the intermittent control, the switching control unit inhibits the gradual control and performs non-gradual control such that, upon beginning the control of the ON and OFF switching, the electric power supplied to the resonance circuit undergoes a one-step increase to reach the target value, and upon stopping the control of the ON and OFF switching, the electric power supplied to the resonance circuit undergoes a one-step decrease from the target value until stopping, during the non-gradual control, when the index value exceeds an allowable level corresponding to an allowable upper threshold of noise, the switching control unit inhibits the non-gradual control and starts the gradual control, and the switching control unit continues the non-gradual control as long as the allowable level is not exceeded.

13. The image formation apparatus of claim 12, wherein the index value is a torque magnitude of a drive source driving the heating target.

14. A switching control method used by an electromagnetic induction heating apparatus performing electromagnetic induction heating of a heating target electromagnetically coupled to an inductor, and comprising a resonant circuit including the inductor connected to a capacitor, a direct-current electric power supply, and a switching element performing ON and OFF switching of electric power supplied to the resonant circuit by the direct-current electric power supply, the switching control method comprising:

an intermittent control step of performing intermittent control of the electric power supplied to the resonant circuit by performing control of the ON and OFF switching by the switching element at regular intervals, and by performing control to stop the electric power supplied to the resonant circuit when not performing the control of the ON and OFF switching; and a gradual control step of, during the intermittent control, upon beginning the control of the ON and OFF switching, the electric power supplied to the resonant circuit undergoing a gradual increase to reach a target value, and upon stopping the control of the ON and OFF switching, the electric power supplied to the resonant circuit undergoing a gradual decrease from the target value until stopping, wherein the gradual control is such that the gradual decrease is performed with fewer steps than the gradual increase.

15. The switching control method of claim 14, further comprising:

a monitoring step of monitoring an index value indicating an acoustic pressure level of sound produced by the heating target, wherein when initiating the intermittent control, the gradual control is inhibited and non-gradual control is performed such that, upon beginning the control of the ON and OFF switching, the electric power supplied to the resonance circuit undergoes a one-step increase to reach the target value, and upon stopping the control of the ON and OFF switching, the electric power supplied to the resonance circuit undergoes a one-step decrease from the target value until stopping, during the non-gradual control, when the index value exceeds an allowable level corresponding to an allowable upper threshold of noise, the non-gradual control is inhibited and the gradual control is started, and the non-gradual control is continued as long as the allowable level is not exceeded.

16. The switching control method of claim 15, wherein the index value is a torque magnitude of a drive source driving the heating target.

* * * * *